US007209693B2

(12) United States Patent
Tachibana et al.

(10) Patent No.: US 7,209,693 B2
(45) Date of Patent: Apr. 24, 2007

(54) IMAGING APPARATUS AND IMAGING METHOD THEREFORE

(75) Inventors: Yuta Tachibana, Toyokawa (JP); Teruhiko Fujikura, Aichi-ken (JP); Kou Yamada, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 218 days.

(21) Appl. No.: 10/974,939

(22) Filed: Oct. 28, 2004

(65) Prior Publication Data

US 2005/0271429 A1 Dec. 8, 2005

(30) Foreign Application Priority Data

Jun. 2, 2004 (JP) ..... 2004-164155

(51) Int. Cl.
*G03G 15/14* (2006.01)

(52) U.S. Cl. ..... 399/301; 347/116; 399/167

(58) Field of Classification Search ..... 399/301, 399/167, 159, 394, 298, 299, 302; 347/116
See application file for complete search history.

(56) References Cited

U.S. PATENT DOCUMENTS 6,282,396 B1 * 8/2001 Iwata et al. ..... 399/301
6,393,244 B1 5/2002 Nakayasu et al.
6,408,157 B1 * 6/2002 Tanaka et al. ..... 399/301
6,771,919 B2 * 8/2004 Koide ..... 399/167
2005/0047834 A1 * 3/2005 Tomita et al. ..... 399/301

FOREIGN PATENT DOCUMENTS

JP 09-062047 3/1997

* cited by examiner

*Primary Examiner*—Sophia S. Chen
(74) *Attorney, Agent, or Firm*—Buchanan Ingersoll & Rooney PC

(57) ABSTRACT

A controller of a color copier according to the invention includes a drive controller section, a pattern generation section, and a velocity information acquisition section. The drive controller section changes the phase relationship in rotation angle between a drive roller driving the transfer belt and individual photosensitive drums of a plurality of imaging sections. The pattern generation section forms registered marks on the transfer belt by using the plurality of imaging sections before and after the drive controller section changes the phase relationship. The velocity information acquisition section acquires at least one of a velocity fluctuation component of individual photosensitive drums and a velocity fluctuation component of the transfer belt in accordance with the result of sensing by a mark sensor for two registered marks formed by the pattern generation section.

20 Claims, 13 Drawing Sheets

IMAGING APPARATUS AND IMAGING METHOD THEREFORE

This application is based on Application No. 2004-164155 filed in Japan, contents of which is hereby incorporated by reference.

BACKGROUND OF THE INVENTION

1. Field of the Invention

The present invention relates to an imaging apparatus, such as a copying machine and a printer, and an imaging method thereof. More specifically, the invention relates to a tandem color imaging apparatus having a plurality of photosensitive drums, and an imaging method thereof.

2. Description of Related Art

Conventionally, imaging apparatuses include those of a type having a plurality of photosensitive drums. An imaging apparatus of this type transfers toner images from individual photosensitive drums to a transfer belt and superpose the images thereon whereby to acquire a color image. In general, in an imaging apparatus of this type, registered marks are formed on the transfer belt and a mark sensor is used to detect them. The detections are performed to enable the toner images, which are formed on the individual photosensitive drums, to be superposed without interposition mismatches on the transfer belt. Then, the results of the detections are used to correct a variety of static positional mismatches caused by positional variations in image creation systems.

However, in rotational driving of components such as driving gears of the photosensitive drums, it is unavoidable that periodical velocity fluctuating components are added to rotational velocities of outer circumferential surfaces of the photosensitive drums. This is attributed to rotation-axis eccentricity of the drums that occurs depending on the manufacturing precision and the like. The occurrence of periodical velocity fluctuating components remains as a problem in achieving high level alignment. This is because the occurrence of periodical velocity fluctuating components causes dynamic positional mismatches, i.e., periodical positional mismatches even after static positional mismatches have been corrected. To overcome the problem, a method has been developed and attempted that detects the phases of individual photosensitive bodies in accordance with registered marks. However, the velocity fluctuation components to be detected in accordance with registered marks are overlap-added with velocity fluctuation components of a transfer-belt driving roller in addition to the velocity fluctuation components of the photosensitive drums. There arises another problem of how to decompose the overlap-added component to detect velocity fluctuation components of the photosensitive drums thereby to obtain precise phases of the photosensitive drums.

Conventionally, various types of methods for detecting a velocity fluctuation component of a transfer belt, which is one of the two components of velocity fluctuation, have been developed. By way of example, according to the techniques disclosed in Japanese Unexamined Patent Application Publication No. 09-62047, multiple marks are preliminarily formed on a transfer belt, and the marks are sensed by sensors at two locations. Thereby, the belt velocity is obtained from the time of movement of the marks between the sensors. By way of another example, techniques according to U.S. Pat. No. 6,393,244, a mark writing means is provided separately from photosensitive drums. The writing means is used to form a mark excluding the velocity fluctuation component of the photosensitive drum. In addition, techniques using electrostatic marks to prevent overuse of toner are also disclosed.

However, any of above mentioned conventional imaging apparatuses and imaging methods thereof requires two sensors to detect the belt velocity. Further, the apparatus disclosed in the latter publication has the dedicated mark writing means and a dedicated mark detecting means. The dedicated means causes increase of costs of the imaging apparatus, and in addition, requires spacing for mounting the individual members.

SUMMARY OF THE INVENTION

The present invention is made to solve the problems with the conventional imaging apparatuses and imaging methods. Accordingly, an object of the invention is to provide an imaging apparatus and an imaging method in which, while an additional sensor, writing means and the like other than those in the conventional techniques are not provided, a velocity fluctuation component of a transfer belt and a velocity fluctuation component of a photosensitive drum are detected separately.

According to a first aspect of the present invention, there is provided an imaging apparatus comprising: a transfer belt; a drive roller that drives the transfer belt; an imaging section that has a cylindrical photosensitive body and that forms patterns on the transfer belt; a phase changing section that changes a phase relationship between a rotation angle of the drive roller and a rotation angle of the photosensitive body; a registered-mark forming section that forms registered marks on the transfer belt by using the imaging section before and after the phase relationship is changed by the phase changing section; a mark sensor that senses marks formed on the transfer belt; and a velocity-fluctuation-component acquisition section that acquires at least one of a velocity fluctuation component of the photosensitive body and a velocity fluctuation component of the transfer belt in accordance with a result of sensing by the mark sensor for the registered marks formed before and after the phase relationship is changed by the phase changing section. The expression "the phase relationship between the rotation angle of the drive roller and the rotation angle of the each individual photosensitive body" refers to the relative relationship of the phases in the rotation of the drive roller and the photosensitive body.

According to the imaging apparatus of the present invention, registered marks are formed in two times on the transfer belt by the registered-mark forming section. Between the two times of pattern forming, the phase relationship in the rotation angle between the drive roller and the photosensitive body is changed by the phase changing section. The two registered marks are sensed by the mark sensor. That is, two registered marks thus formed have the phases of velocity fluctuation components that are different from each other. Accordingly, in accordance with the sensed results, calculations can be performed to provide a component which is obtained to eliminate the influence of at least one of the velocity fluctuation component of the individual photosensitive drum and the velocity fluctuation component of the transfer belt. Consequently, according to the imaging apparatus, the velocity fluctuation component of the transfer belt and the velocity fluctuation component of the photosensitive drum can be separately detected. In this case, components such as a sensor and writing means other than a conventionally provided mark sensor need not be added.

Furthermore, according to a second aspect of the present invention, there is provided an imaging method for an imaging apparatus comprising a transfer belt, a drive roller that drives the transfer belt, and an imaging section that has a cylindrical photosensitive body, the method comprising the steps of: forming first registered marks on the transfer belt by using the imaging section; changing a phase relationship between a rotation angle of the drive roller and that of the photosensitive body after the first registered marks has been formed; forming a second registered marks on the transfer belt by using the imaging section after the phase relationship has been changed; sensing the first registered marks; sensing the second registered marks; and acquiring at least one of a velocity fluctuation component of the photosensitive body and a velocity fluctuation component of the transfer belt in accordance with a result of the sensing of the first and second registered marks.

BRIEF DESCRIPTION OF DRAWINGS

For a better understanding of the present invention, reference is made to the following detailed description of the invention, just in conjunction with the accompanying drawings in which.

DETAILED DESCRIPTION OF PREFERRED EMBODIMENTS

Referring to the accompanying drawings, a particularized best embodiment of the present invention will be described in detail herein below. The embodiment is configured by adapting the present invention to a tandem color copier having a plurality of photosensitive drums.

Figure 1:
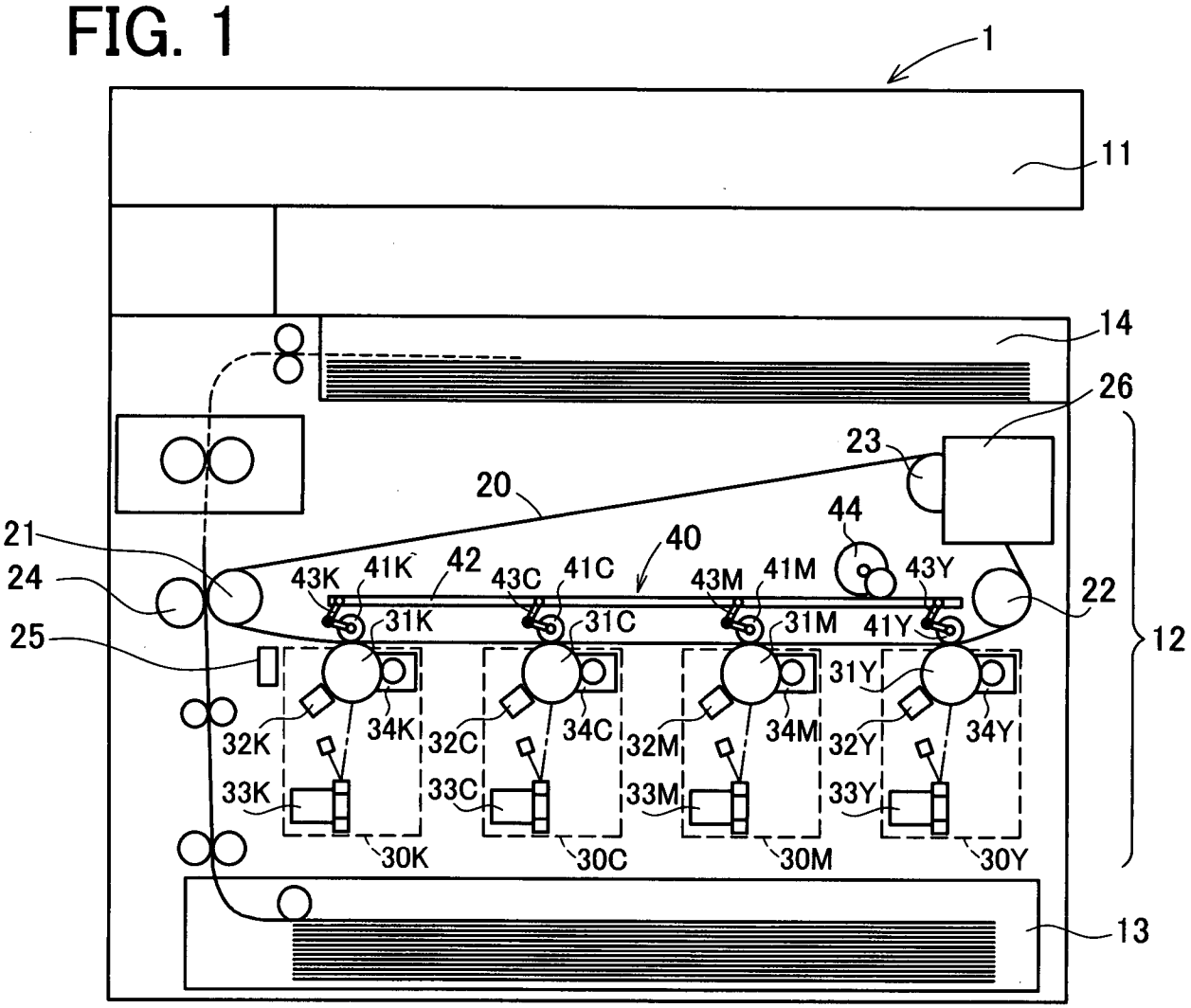
FIG. 1 is a configuration view schematically showing the configuration of a color copier of an embodiment according to the present invention.

With reference to FIG. 1, the color copier, which is denoted by reference numeral 1, has a document reader section 11, an image section 12, and a paper feed cassette 13. Image data read out in the document reader section 12, and a provided to the image section 12 to form an image on a to-be-image paper sheet fed upward, as viewed on the drawing, from the paper feed cassette 13, and the sheet is ejected to an ejection section 14. The image section 12 has a transfer belt 20, image forming units 30K, 30C, 30M, and 30Y provided along therewith, and a primary transfer section 40. The primary transfer section 40 opposes color image forming units 30K, 30C, 30M, and 30Y for forming individual colors, and is provided in such a manner as to sandwich the transfer belt 20 with the color image forming units 30K, 30C, 30M, and 30Y. It should be understood that throughout the application various parts may be illustrated in the drawings or mentioned in the specification with or without subscripts "K," "C," "M," and "Y". The purpose of those subscripts is to illustrate a color to which a particular part is associated with. When a part is mentioned without and subscript, that part is meant to generically refer to corresponding parts associated with any color, i.e., K, C, M or Y. Thus, in many cases the use of the reference characters K, C, M and Y will hereafter be omitted when the colors represented thereby need not be identified in order to relay the required information to one skilled in the art. Where a part is shown in the figures without a color identifying character, K, C, M or Y, it should be understood that the part is meant to illustrate to a person of skill in the art that it may correspond to one of the colors, or to all three. See for example, part 61 in FIG. 2 of the present application.

As is shown in FIG. 1, the transfer belt 20 is entrained about three belt rollers (a drive roller 21, a driven roller 22, and a tension roller 23). An on-paper transfer roller 24 is disposed at a position opposing the drive roller 21 with the transfer belt 20 being sandwiched there between. In addition, a mark sensor 25 is provided on the left side of the individual color image forming units 30 and below the transfer belt 20, as viewed in the drawing. The mark sensor 25 detects, for example, registered marks formed on the transfer belt 20. Further, a cleaner section 26 for removing toner staying on the transfer belt 20 is provided adjacent to the tension roller 23.

Each individual color image forming units 30 has a photosensitive drum 31, as shown in FIG. 1; and there around, a charging device 32, an exposure device 33, and a developing device 34 are disposed. The exposure device 33 may be either a laser exposure device or an exposure device formed of a LED unit. Similarly, the other devices are not limited to the described and shown types. The devices of each individual image forming unit 30 are of a general type, so that further detailed description thereof is omitted. In the color copier 1, photosensitive drums 31 and the drive roller 21 of the transfer belt 20 are formed of a roller having a same diameter.

As is shown in FIG. 1, the primary transfer section 40 has primary transfer rollers 41K, 41C, 41M, and 41Y for individual colors that are coupled to a single connection bar 42 by respective L-shaped member 43K, 43C, 43M, and 43Y. The connection bar 42 is a bar member disposed parallel with the transfer belt 20 in the primary transfer section 40, and is driven by a bar shift motor 44 to be reciprocatable in the longitudinal direction thereof (left-right direction, as viewed in the drawing). One ends of the individual L-shaped members 43 are rotatably mounted to the connection bar 42 at same intervals as the individual primary transfer rollers 41. The other ends of the individual L-shaped members 43 are rotatably mounted to rotation axes of the individual primary transfer rollers 41. Further, pivotal joint portions of the individual L-shaped members 43 are rotatably to a housing or the like of the color copier 1.

Figure 2:
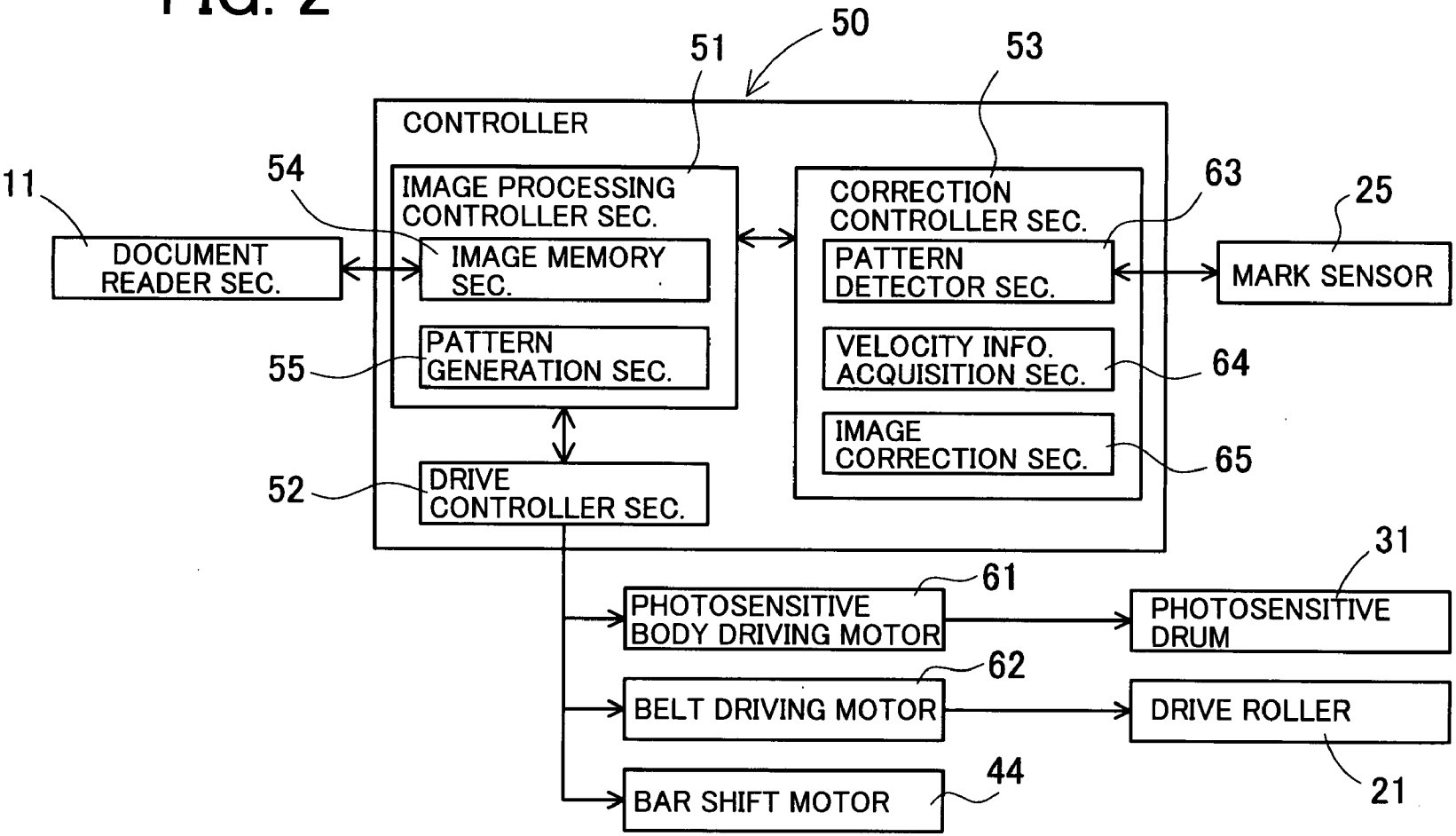
FIG. 2 is a block diagram schematically showing a control configuration of the color copier.

With reference to FIG. 2, the color copier 1 has a controller 50 that controls individual sections; that is, the controller 50 performs control of the entirety (overall system) of the color copier 1. The controller 50 has an image processing controller section 51, a drive controller section 52, and a correction controller section 53. The image processing controller section 51 has an image memory section 54 for storing image data and a pattern generation section 55 for forming registered marks for various types of corrections. Image data read out by the document reader section 11 is processed by the image processing controller section 51.

The drive controller section 52 controls components such as photosensitive body driving motors 61 that drive the photosensitive drums 31, a belt driving motor 62 that drives the drive roller 21, and a bar shift motor 44 that drives the connection bar 42 of the primary transfer section 40. Control by the drive controller section 52 for the photosensitive body driving motors 61 and the belt driving motor 62 include control during ordinary image forming as well as phase shifting and phase matching. For the photosensitive body driving motors 61, stepping motors capable of performing accurate rotation control are used in the color copier 1. A photosensitive body driving motor 61 is provided for each individual color photosensitive drum 31. For the belt driving motor 62, a general-purpose brushless motor may be used.

The correction controller section 53 is a controller portion for improving image quality of formed images by correcting color irregularity and so on. The correction controller section 53 has a pattern detector section 63 that receives an input of the result of detection performed by the mark sensor 25; a velocity information acquisition section 64 that calculates, for example, a velocity fluctuation component of the transfer belt 20 or the photosensitive drum 31 in accordance with the detection result; and an image correction section 65 that corrects image data by using an acquired velocity fluctuation component, registered mark correction information, and the like.

Figure 3:
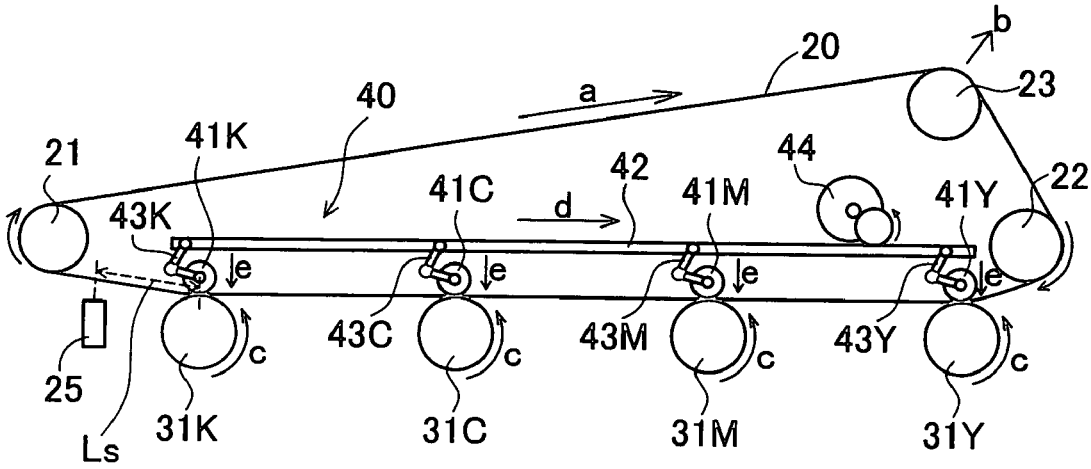
FIG. 3 is an explanatory view showing a press-contact state of a transfer belt.

While image forming being performed by the color copier 1, the drive controller section 52 controls the photosensitive body driving motor 61, the belt driving motor 62, and the like, whereby the photosensitive drum 31, the drive roller 21, and the like are rotated. Thereby, as shown in FIG. 3, the transfer belt 20 is rotated by the rotation of the drive roller 21 in the direction of the arrow 'a' shown in the drawing, and a tension is applied by the tension roller 23 along the direction of the arrow 'b' shown in the drawing. Further, individual photosensitive drums 31 are rotated in the direction of arrows 'c' shown in the drawing. As such is the operation, the mark sensor 25 is disposed downstream of photosensitive drums 31.

In case the transfer belt 20 and photosensitive drums 31 are rotated while being in press contact, they are driven and controlled to cause the surface velocities thereof to be equalized. In the present embodiment, the drive roller 21 and each photosensitive drum 31 are formed of rollers having the same diameter, so that each photosensitive drum 31 and the drive roller 21 are rotated at the same angular velocity.

Figure 4:
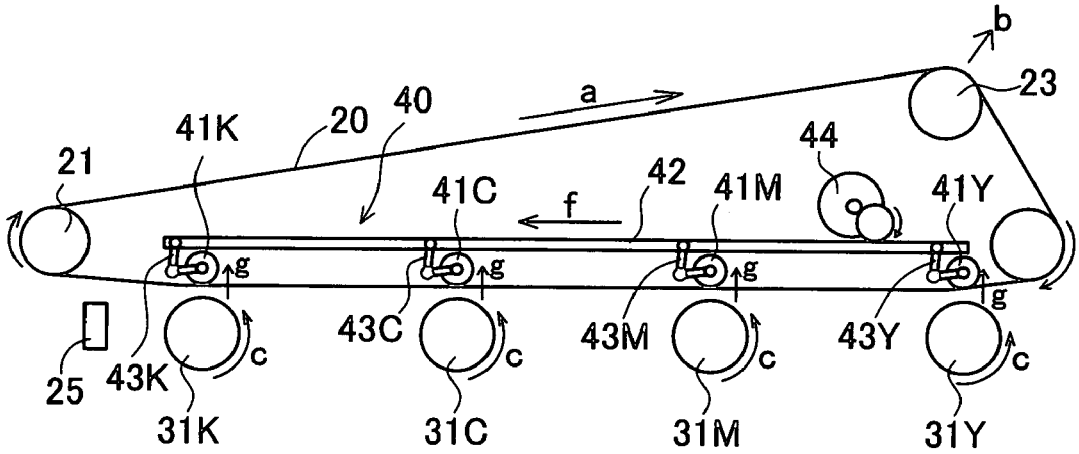
FIG. 4 is an explanatory view showing a disengagement state of the transfer belt.

Operation of the primary transfer section 40 of the color copier 1 will now be described hereunder. With reference to FIGS. 3 and 4, the bar shift motor 44 is driven, and thereby the connection bar 42 is moved in the left and right directions, as viewed in the drawing. Thereby, individual L-shaped members 43 are rotated on the pivotal joint portions, and individual color primary transfer rollers 41 are moved up and down, as viewed in the drawing. As shown in FIG. 3, when the connection bar 42 is moved in the right direction as viewed in the drawing (direction of the arrow 'd'), primary transfer rollers 41 are moved downward as viewed in the drawing (direction of the arrow 'e') and the transfer belt 20 is pressed on individual photosensitive drums 31. On the other hand, as shown in FIG. 4, when the connection bar 42 is moved in the left direction as viewed in the drawing (direction of the arrow 'f'), primary transfer rollers 41 are moved upward as viewed in the drawing (direction of the arrow 'g'). Since a tension is applied by the tension roller 23 to the transfer belt 20 in an obliquely upward direction as viewed in the drawing, the transfer belt 20 is disengaged from individual photosensitive drums 31. That is, in the primary transfer section 40, a belt-position shifting device is configured of the bar shift motor 44, the connection bar 42, and L-shaped members 43.

The color copier 1 performs various correction processing for image correction, for example, at a power-ON time and while non-imaging time. To perform the processing, first, individual color registered marks are formed on the transfer belt 20 by the pattern generation section 55. The formed registered marks are detected by the mark sensor 25 and detection results are input to the pattern detector section 63. The detection results are used in the correction controller section 53 to calculate, for example, positional mismatches and distortions, and correction data is thereby acquired. In imaging processing, image data acquired by the document reader section 11 is appropriately processed in the image processing controller section 51 by using the correction data, and imaging is performed in the imaging section 12.

Further, while power-ON time, processing for acquiring velocity fluctuation components of the photosensitive drum 31 and of the transfer belt 20 is performed. As described in conjunctions with the problems to be solved, this processing is performed for the reasons that it is unavoidable that velocity fluctuation components due to eccentricity are applied to the velocities of the outer circumferential surface of the individual photosensitive drums 31; and when they are different in the individual colors from one another, the results appear as color irregularities in a formed image. In general, a velocity fluctuation component due to eccentricity appears in the form of a variation of a shape approximated with a sine wave of a surface velocity, and the amplitude thereof is depending on the eccentricity level of a drive system.

As such, in the color copier 1, parts collected from a same portion of a metal mold in molding are used for driving gears for individual color photosensitive drums 31. In this manner, since the eccentricity levels of individual driving gears are equalized, the amplitudes of the velocity fluctuation components of individual color photosensitive drums 31 are equalized. Accordingly, the velocity fluctuation components of individual color photosensitive drums 31 are made consistent with one another simply by matching phases of individual driving gears with one another.

In the color copier 1, when performing monochrome copying, only the black image forming unit 30K is driven for, for example, wear prevention and power saving. As such, different drive processings are performed for the photosensitive body driving motor 61K for the photosensitive drum 31K and for photosensitive body driving motors 61C, 61M, and 61Y for the other three color photosensitive drums 31C, 31M, and 31Y. For the three other-than-black color photosensitive body driving motors 61C, 61M, and 61Y, same drive processing is performed at all times. For this reason, drive systems with the three other-than-black color photosensitive body driving motors 61C, 61M, and 61Y are assembled in manufacture to have matched phases of the driving gears, whereby no phase difference exists among them.

However, in the monochrome copying, since the photosensitive drum 31K is driven according to different processing from the processing for the other three color photosensitive drums 31C, 31M, and 31Y, a phase difference can take place therebetween. To solve this problem, the color copier 1 is designed such that a phase difference between any one of the other three color photosensitive drums 31C, 31M, and 31Y and the photosensitive drum 31K is detected and corrected. Thereby, a phase matching of individual photosensitive drums 31 for all four colors can be attained. The phase matching of photosensitive drums 31 signifies that phases of individual photosensitive drums 31 with respect to the transfer belt 20 are matched. As the result of the phase matching of photosensitive drums 31, images formed by individual color photosensitive drums 31 are superposed on the transfer belt 20 without being positional mismatched with one another.

In the present case, a phase difference is detected between the photosensitive drum 31C located proximity to the photosensitive drum 31K and the photosensitive drum 31M. The color copier 1 is designed such that the photosensitive drum 31K and the photosensitive drum 31C are spaced away from each other by a distance corresponding to circumference of the photosensitive drum 31C. Accordingly, when forming a registered marks corresponding to one cycle of photosensitive drums 31, the photosensitive drum 31K and the photosensitive drums 31C are able to concurrently initiate forming of registered marks. Thereby, time necessary for phase detection can be reduced. As such, firstly, the image forming units 30K and 30C form registered marks on the transfer belt 20, and the mark sensor 25 detects the marks.

In this case, if the transfer belt 20 all time runs at a constant velocity, in accordance with variations in detection time interval in the event that multiple marks formed with intendedly identical intervals are sequentially detected, fluctuating components of surface velocities of the photosensitive drums 31 can be acquired. In reality, however, velocity fluctuation component due to eccentricity occurs also with the drive roller 21. The result of the detection thereof consequently is overlap-added with the velocity fluctuation component of the transfer belt 20 when forming registered marks and when detecting the marks by the mark sensor 25, respectively. In this case, the drive roller 21 and the photosensitive drum 31 are formed to have the same diameter and are rotated at the same angular velocity. Accordingly, the velocity fluctuation component of the transfer belt 20 and the velocity fluctuation component of the photosensitive drum 31 individually take the forms of sine waves with an equal cycle.

According to the detection method in the present embodiment, two times of forming and detection of registered marks are performed. More specifically, after first time of forming and detection of registered marks, the photosensitive drums 31K and 31C are each 180° rotated, second time of forming and detection of that is performed. The velocity fluctuation components of the individual photosensitive drums 31K and 31C can be extracted from the results of the two times of the detection by the velocity information acquisition section 64. Using the extraction results, the phases of the photosensitive drums 31K and 31C can be acquired. In practical imaging processing, the drive controller section 52 performs control of the photosensitive body driving motor 61K for the photosensitive drum 31K and the photosensitive body driving motor 61C for the photosensitive drum 31C so that the photosensitive drum 31K and the photosensitive drum 30C have the same phase. Thereby, color irregularity can be corrected.

More specifically, the transfer belt 20 is placed into a press-contact state shown in FIG. 3. In this state, equal interval patterns corresponding to the one cycle are formed on the photosensitive drums 31K and 31C and are detected by the mark sensor 25. Variations in mark interval are acquired in accordance with the detection result, and waveforms corresponding to velocity fluctuation components are acquired. Subsequently, the bar shift motor 44 is activated whereby to place the transfer belt 20 into a disengaged state shown in FIG. 4. Further, control is performed to accelerate or decelerate the individual photosensitive body driving motors 61 for a predetermined time. That is, a relative velocity between the transfer belt 20 and individual photosensitive drums 31 is changed for a predetermined time. Alternatively, instead of individual photosensitive body driving motors 61, the belt driving motor 62 may be controlled to accelerate or decelerate for a predetermined time. The phase of individual photosensitive drums 31 is thus 180° shifted. This is "phase shifting." Thereby, the phase relationship between the drive roller 21 and individual photosensitive drums 31 is changed. Then, the bar shift motor 44 is driven whereby to again place the transfer belt 20 into the press-contact state. Subsequently, similar to the above, the second time of pattern forming and detection is performed, and waveforms corresponding to second velocity fluctuation components are acquired in accordance with variations in mark intervals.

In the above, control is preferably performed so that the phase of the drive roller 21 in the second pattern forming is the same as that in the first pattern forming. In the present case, the belt driving motor 62 is kept rotated in a state where an average velocity thereof is constant, and elapsed time is measured, whereby to generate timing thereof. Thereby, in comparison to the first velocity fluctuation waveform, the second velocity fluctuation waveform is formed such that the velocity fluctuation waveform of the photosensitive drum 31 in the 180°-shifted reverse phase is overlap-added to the velocity fluctuation waveform of the transfer belt 20 in the same phase. Accordingly, the sum of the two velocity fluctuation waveforms or the difference therebetween is acquired, any one of the velocity fluctuation component of the transfer belt 20 and the velocity fluctuation component of the photosensitive drum 31 is offset, and the waveform of the velocity fluctuation component (with a doubled amplitude) of the other remaining one. This is because the cycles of the two velocity fluctuation components are identical.

A procedure of acquiring the phase of the photosensitive drum 31K will be described hereunder by using practical example waveforms with reference to FIGS. 5 to 13. The individual drawings show enlarged amplitudes of velocity fluctuation components. In descriptions below, velocity fluctuations are approximated by sine waves.

Figure 5:
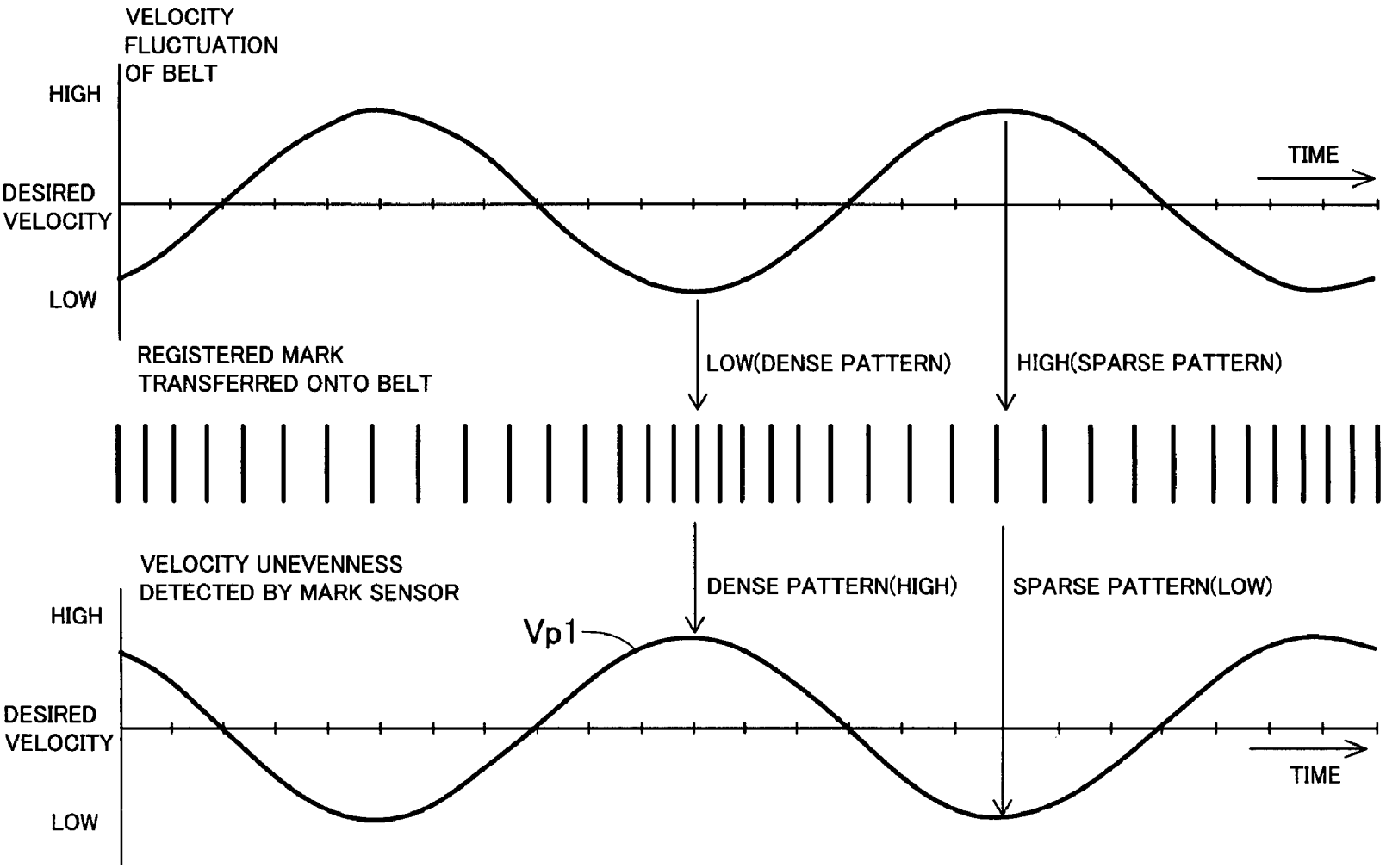
FIG. 5 is a graph showing an example velocity fluctuation component to be detected.

Of velocity fluctuation components of the transfer belt 20, a velocity fluctuation component $V_{p1}$ in the pattern forming is represented by equation (1) given below. The component is shown in FIG. 5.

$$V_{P1}=-A_1 \sin(\omega_1 t+p_1) \quad (1)$$

In the equation, $A_1$ represents the fluctuation amplitude of the drive roller 21, $\omega_1$ represents the angular velocity of the drive roller 21, and $p_1$ represents the phase of the drive roller 21. As shown in the drawing, when the velocity of the transfer belt 20 in the pattern forming is high, registered marks to be formed is sparse, so the detection result thereof is shown as if the velocity is low. Specifically, the velocity fluctuation component $V_{p1}$ appears in the form of the reverse phase with respect to the velocity fluctuation of the drive roller 21.

Figure 6:
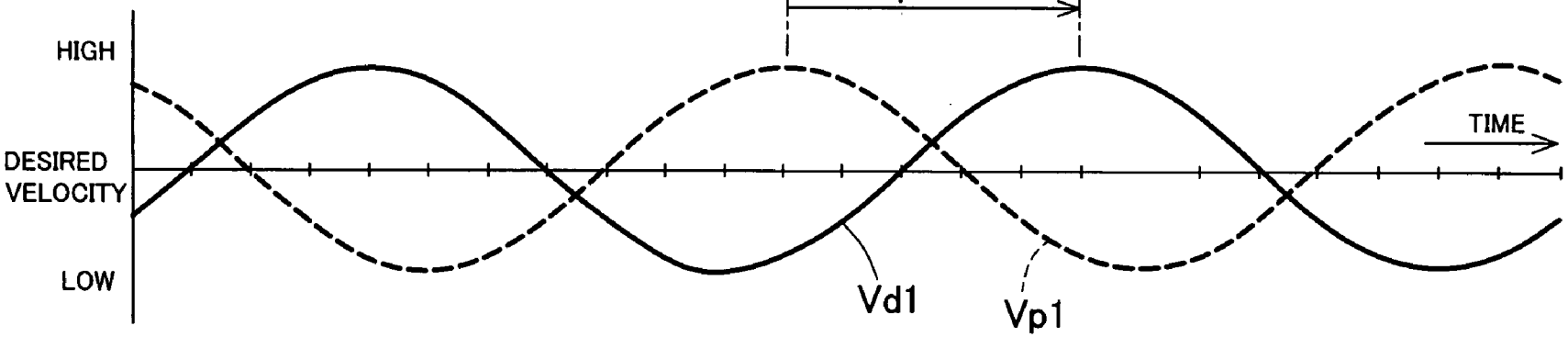
FIG. 6 is a graph showing an example velocity fluctuation component to be detected.

However, a velocity fluctuation component to be detected by the mark sensor 25 is delayed by a phase $P_{s1}$ corresponding to a distance $L_s$ between the photosensitive drum 31K and the mark sensor 25. $L_s$ is a belt running directional distance which starts from a contact point of the photosensitive drum 31K and the transfer belt 20 and terminates at a detection point on the transfer belt 20 detected by the mark sensor 25. Accordingly, a velocity fluctuation component $V_{d1}$ when being detected by the mark sensor 25 in accordance with the velocity fluctuation component $V_{p1}$ in the pattern forming is represented by equation (2) given below. The component is shown in FIG. 6.

$$V_{d1}=-A_1 \sin(\omega_1 t+p_1-p_{s1}) \tag{2}$$

In this case, when $\phi_1$ is the diameter of the drive roller 21 and $L_1$ is the outer periphery, the following is established:

$$p_{s1}=(2\pi/L_1)\times L_s, \text{ and}$$

$$L_1=\pi\omega_1.$$

Figure 7:
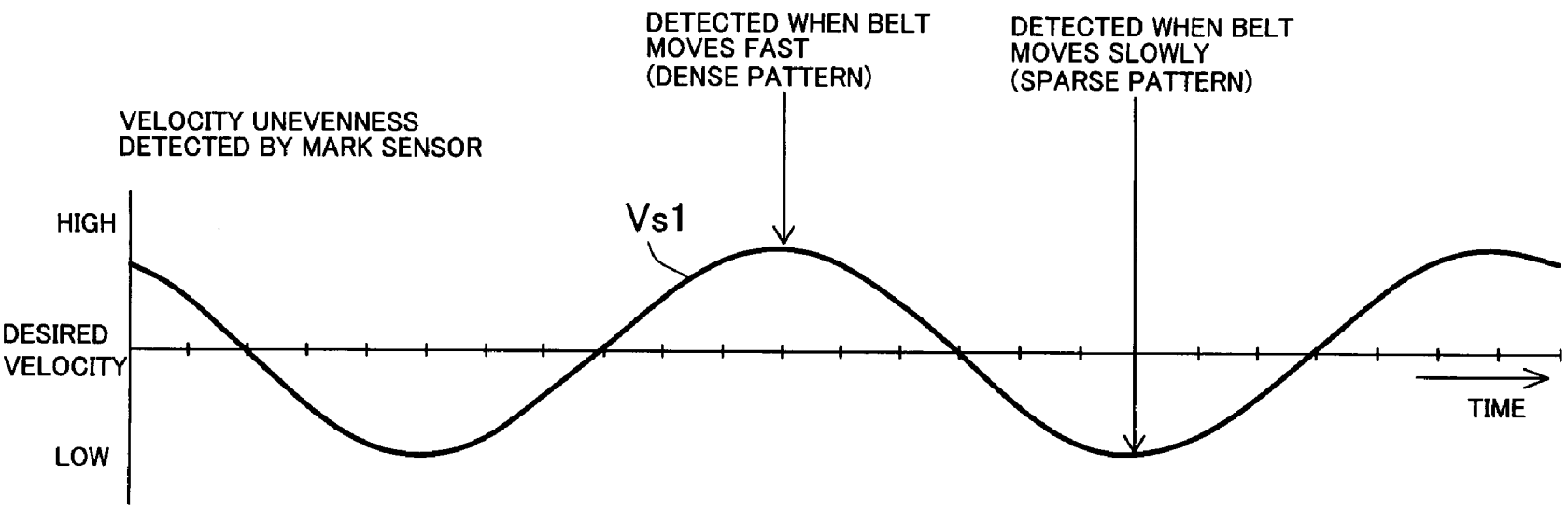
FIG. 7 is a graph showing an example velocity fluctuation component to be detected.

A velocity fluctuation component $V_{s1}$ of the transfer belt 20 in the pattern detection is identical to that of the drive roller 21, and is represented by equation (3) given below. The component is shown in FIG. 7.

$$V_{s1}=A_1 \sin(\omega_1 t+p_1) \tag{3}$$

Figure 8:
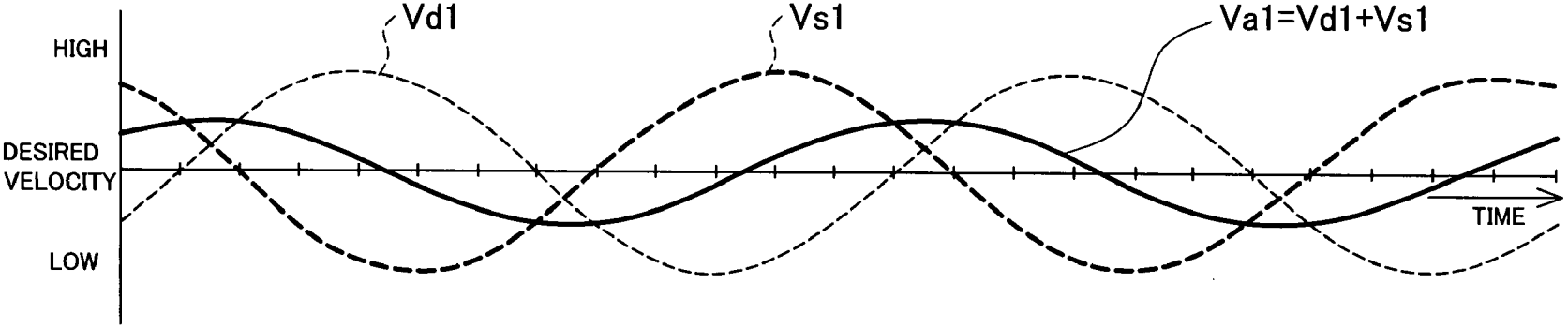
FIG. 8 is a graph showing an example velocity fluctuation component to be detected.

Accordingly, $V_{a1}$, the total of the velocity fluctuation components of the transfer belt 20 to be detected by the mark sensor 25, is represented by equation (4) given below. The component is shown in FIG. 8.

$$\begin{aligned} V_{a1} &= V_{s1} + V_{d1} \\ &= A_1\sin(\omega_1 t + p_1) - A_1\sin(\omega_1 t + p_1 - p_{s1}) \end{aligned} \tag{4}$$

Further, $V_{a1}$ is represented by the following equation (5) in accordance with a trigonometric function formula:

$$\begin{aligned} V_{a1} &= A_1\{\cos p_1 - \cos(p_1 - p_{s1})\}\sin\omega_1 t + \\ &\quad A_1\{\sin p_1 - \sin(p_1 - ps_1)\}\cos\omega_1 t \\ &= (u^2 + v^2)^{1/2}\sin(\omega_1 t + \alpha) \end{aligned} \tag{5}$$

Where $u=A_1\{\cos p_1-\cos(p_1-p_{s1})\}$,
$v=A_1\{\sin p_1-\sin(p_1-p_{s1})\}$, and
$\alpha=\tan^{-1}(v/u)$.

Figure 9:
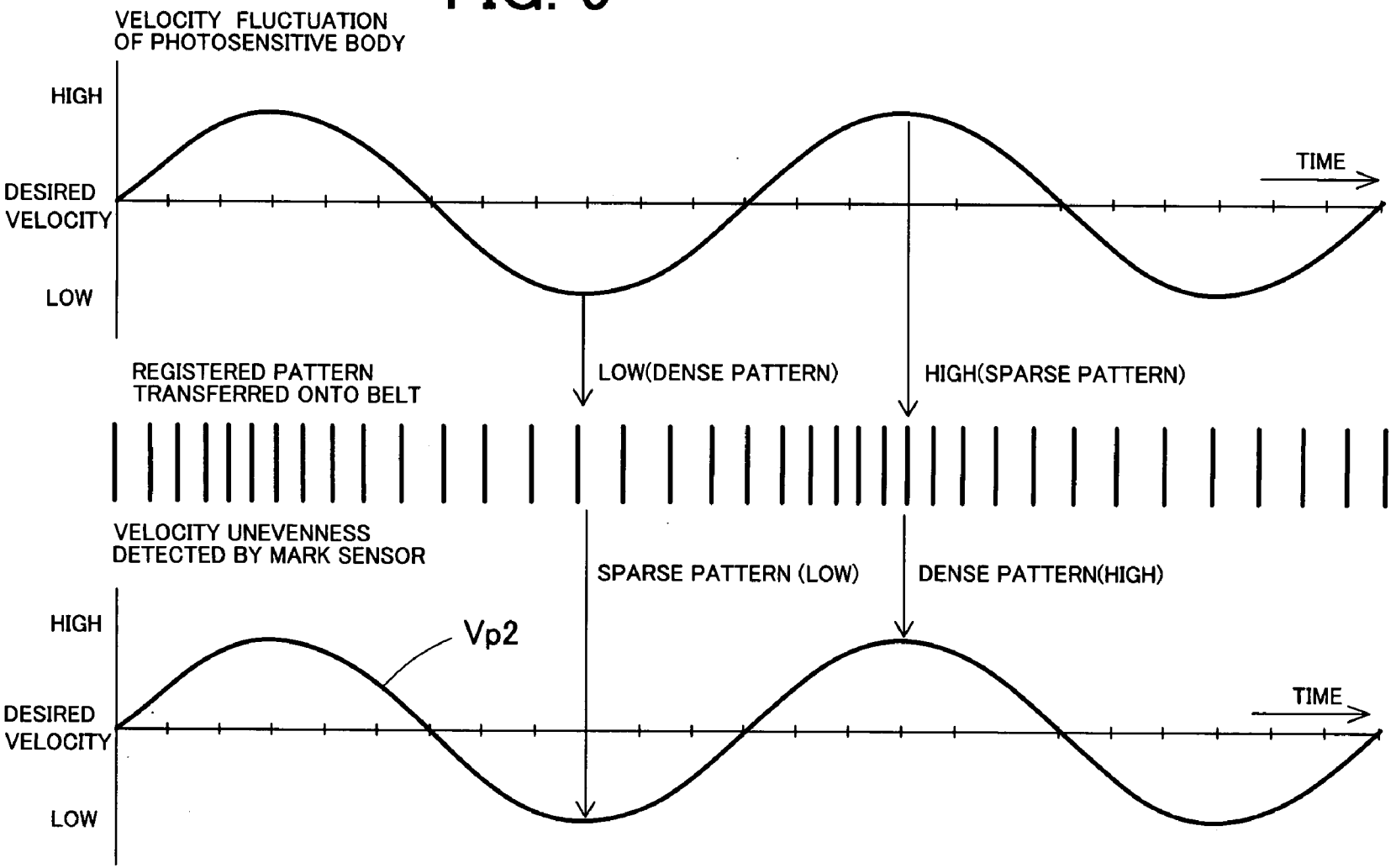
FIG. 9 is a graph showing example velocity fluctuation components to be detected.

The velocity fluctuation component of the photosensitive drum 31K will be described hereunder. A velocity fluctuation component $V_{p2}$ of a pattern to formed on the transfer belt 20 is represented by equation (6) given below. The component is shown in FIG. 9.

$$V_{P2}=-A_2 \sin(\omega_2 t+p_2) \tag{6}$$

In the equation, $A_2$ represents the fluctuation amplitude of the photosensitive drum 31K, $\omega_2$ represents the angular velocity of the photosensitive drum 31, and $p_2$ represents the phase of the photosensitive drum 31K.

Figure 10:
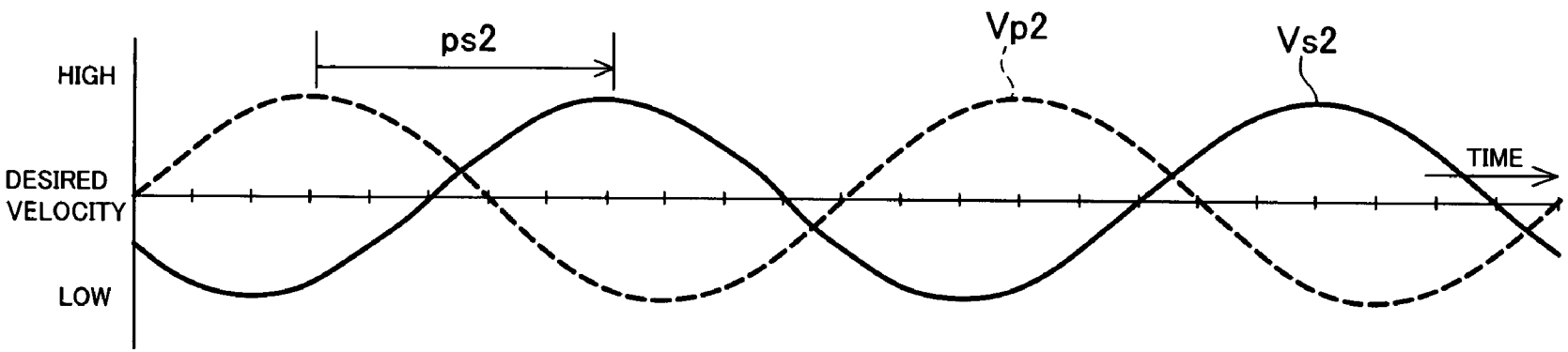
FIG. 10 is a graph showing an example velocity fluctuation component to be detected.

However, a velocity fluctuation component to be detected by the mark sensor 25 is delayed by a phase $p_{s2}$ corresponding to a distance $L_s$ between the photosensitive drum 31K and the mark sensor 25. Accordingly, a velocity fluctuation component $V_{s2}$ to be detected by the mark sensor 25 in accordance with the velocity fluctuation component of the photosensitive drum 31 is represented by equation (7) given below. The component is shown in FIG. 10.

$$V_{s2}=A_2 \sin(\omega_2 t+p_2-p_{s2}) \tag{7}$$

In this case, when $\phi_2$ is the diameter of the photosensitive drum 31K and $L_2$ is the outer periphery, the following is established:

$$p_{s2}=(2\pi/L_2)\times L_s, \text{ and}$$

$$L_2=\pi\phi_2.$$

Figure 11:
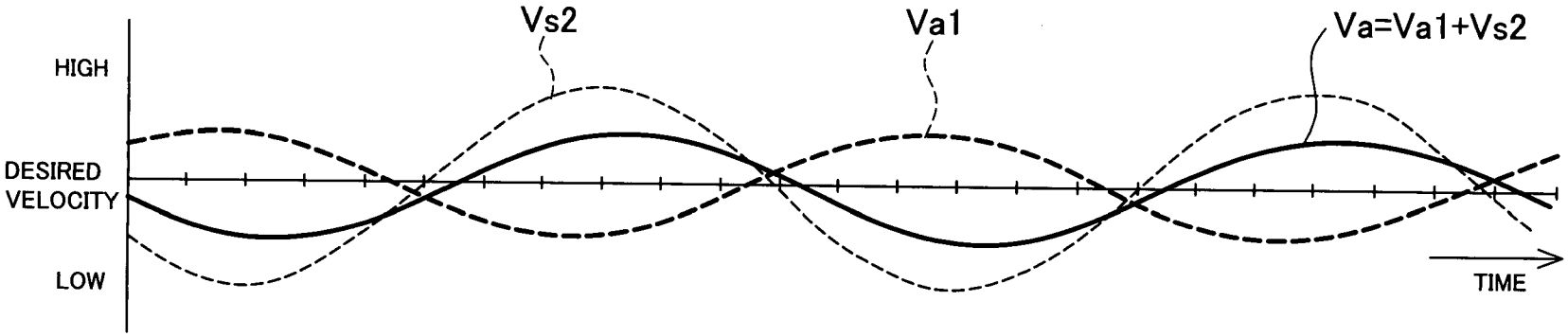
FIG. 11 is a graph showing an example velocity fluctuation component to be detected.

Accordingly, a total velocity fluctuation component $V_a$ when both the photosensitive drum 31K and transfer belt 20 have the velocity fluctuation components is the total of equations (5) and (7) given above. The total is represented by the following equation (8) and is shown in FIG. 11.

$$\begin{aligned} V_a &= V_{s2} + V_{a1} \\ &= A_2\sin(\omega_2 t + p_2 - p_{s2}) + (u^2 + v^2)^{1/2}\sin(\omega_1 t + \alpha) \end{aligned} \tag{8}$$

According to the configuration of the color copier 1, the following is established:

$$\phi_1=\phi_2=\phi$$

Accordingly, the following is established:

$$L_1=L_2=L$$

$$\omega_1=\omega_2=\omega$$

$$p_{s1}=p_{s2}=p_s$$

From the above, the above described velocity fluctuation component $V_a$ is represented by the following equation (9)

$$V_a=A_2 \sin(\omega t+p_2-p_s)+(u^2+v^2)^{1/2} \sin(\omega t+\alpha) \tag{9}$$

Where $u=A_1\{\cos p_1-\cos(p_1-p_s)\}$,
$v=A_1\{\sin p_1-\sin(p_1-p_s)\}$, and
$\alpha=\tan^{-1}(v/u)$.

Figure 12:
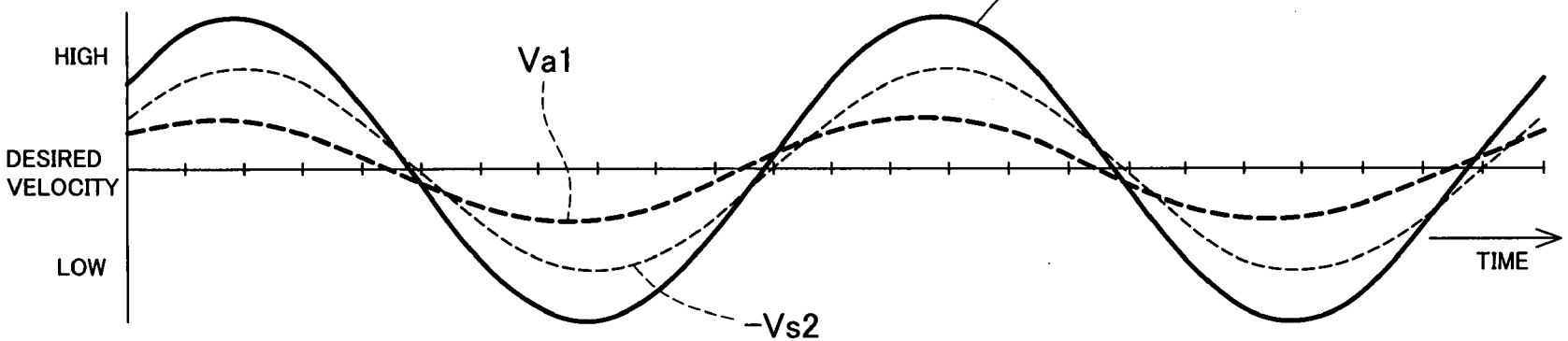
FIG. 12 is a graph showing an example velocity fluctuation component to be detected.

Then, a second velocity fluctuation component $V_b$ detected by 180° shifting the photosensitive drum 31K is represented by equation (10) below. The component is shown in FIG. 12.

$$\begin{aligned} V_b &= A_2\sin\{(\omega t + p_2 - p_s) - \pi\} + (u^2 + v^2)^{1/2}\sin(\omega t + \alpha) \\ &= -A_2\sin(\omega t + p_2 - p_s) + (u^2 + v^2)^{1/2}\sin(\omega t + \alpha) \end{aligned} \tag{10}$$

Figure 13:
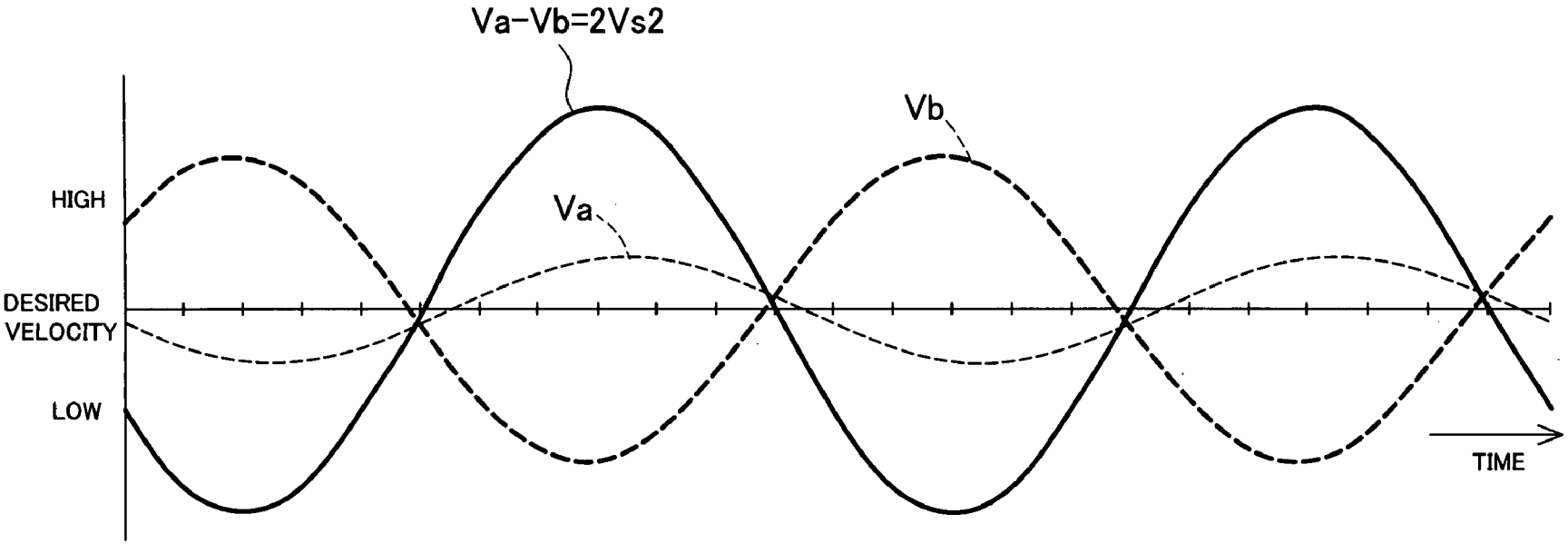
FIG. 13 is a graph showing an example velocity fluctuation component to be detected.

The difference between the first and second velocity fluctuation components is the difference between the equations (9) and (10), so that the doubled component of the velocity fluctuation component $V_{s2}$ of the photosensitive drum 31K can be obtained according to equation (11) given below. The component is shown in FIG. 13.

$$V_a - V_b = 2A_2\sin(\omega t + p_2 - p_s) \quad (11)$$
$$= 2V_{s2}$$

A phase $p_2$ of the photosensitive drum 31K can be obtained from the above. Alternatively, when the total of equations (9) and (10) is obtained, the velocity fluctuation component $V_{s2}$ can be erased. Accordingly, also the velocity fluctuation component of the transfer belt 20 can be obtained.

Similarly, also the phase of the photosensitive drum 31C can be obtained. Accordingly, the difference in the phases of the photosensitive drum 31K and the photosensitive drum 31C can be obtained, thereby enabling these phases to be controlled by the drive controller section 52 to match one another. This enables preventing dynamic color irregularity attributed to the velocity fluctuating components of the individual color photosensitive drums 31.

Figure 14:
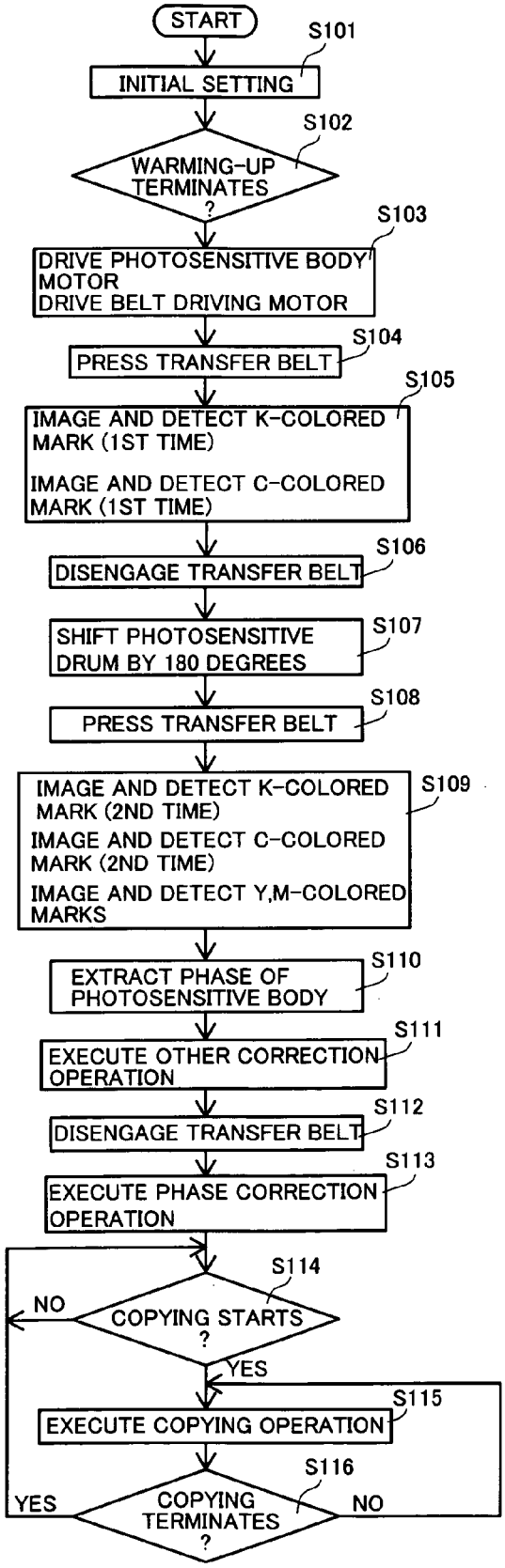
FIG. 14 is a flow diagram showing velocity-component acquisition method.

Operation and processing of the color copier 1 will now be described hereunder with reference to a flowchart shown in FIG. 14. In the color copier 1, the above processes of acquiring the velocity components of, for example, the transfer belt 20 and the photosensitive drum 31 are executed at each power-on time. Firstly, when the power for the color copier 1 is turned on, the operation performs initializations of individual sections (S101). Then, the color copier 1 enters a standby mode until warm-up finishes (S102).

Subsequently, the drive controller section 52 drives and controls photosensitive body driving motors 61 to rotate photosensitive drums 31. Concurrently, the belt driving motor 62 is controlled to drive the drive roller 21, whereby the transfer belt 20 is rotated (S103). After the rotation of these components has been stabilized, the operation drives the bar shift motor 44 thereby to place the transfer belt 20 into the press-contact state shown in FIG. 3 (S104).

Subsequently, registered marks are generated by the pattern generation section 55 to be formed on the transfer belt 20. Pattern forming is concurrently initiated by the black image forming unit 30K and the cyan image forming unit 30C, whereby the patterns corresponding to one cycle of the each individual photosensitive drum 31 is rendered. Subsequently to the pattern forming, pattern detection is performed by the mark sensor 25 (S105).

Upon completion of forming and detection of the one-cycle resist patterns, the bar shift motor 44 is driven, whereby to place the transfer belt 20 in the disengagement state (S106). Then, photosensitive body driving motors 61 are controlled, and photosensitive drums 31 are thereby 180° rotated (S107). Further, the elapsed time is measured, whereby while the phase of the transfer belt 20 is being adjusted, the transfer belt 20 is again placed into the press-contact state (S108).

Subsequently, in a similar manner to that at S105, black and cyan registered marks are rendered, and the second pattern detection is performed by the mark sensor 25 (S109). At this step, preferably, yellow and magenta pattern rendition and detection are continually performed. Then, data retrieval also is preferably performed to retrieve the second pattern detection result of black and cyan as well as data for static positional mismatch correction in the belt-driven direction. This enables the time necessary for the pattern rendition and detection to be reduced. Further, velocity fluctuation components are acquired by the velocity information acquisition section 64 from the results of S105 and S109, and the individual phases of the photosensitive drums 31K and 31C are acquired (S110).

Subsequently, other correction operations, such as resist correction of static positional mismatches and AIDC (automatic image density correction) control are performed (S111). Then, the transfer belt 20 is placed into the disengagement state (S112), individual photosensitive drums 31 are stopped at a phase-matched position in accordance with the result of S110 (S113), and the operation awaits a copy instruction entered by a user (S114).

When a copy start button is depressed by user (S114: Yes), copy operation is executed (S115). Further, the copy operation is continued (S115) until the instructed copy operation finishes (S116: No). Upon termination of the copy operation (S116: Yes), the operation enters in a standby mode until another copy instruction is input (S114). Subsequently, the operation iterates the routine of from S114 to S116 until the power is turned down. The above completes description of the operation and processing of the color copier 1.

As described above in detail, according to the color copier 1, ordinary registered marks are formed by individual photosensitive drums 31 on the transfer belt 20, the formed registered marks are detected by the ordinary mark sensor 25. The operation is performed two times, wherein the second operation is performed after 180° rotating the photosensitive drums 31 with respect to the transfer belt 20. This manner of operation enables obtaining two-type detection results of the reversed phases of the overlap-added velocity fluctuation components of the each individual color photosensitive drum 31. Further, at this time, when the velocity fluctuation components of the transfer belt 20 is adjusted to have the same phase, the total of or difference between the two-type detection results is acquired, whereby to enable acquiring the velocity component of the each individual photosensitive drum 31 or the transfer belt 20. Consequently, the velocity fluctuation component of the transfer belt 20 and the velocity fluctuation component of the each individual photosensitive drum 31 can be separately detected even without addition of components such as a sensor and writing means other than the conventionally provided mark sensor 25. When rotating the photosensitive drums 31 with respect to the transfer belt 20, the bar shift motor 44 operates to disengage the transfer belt 20 from the individual photosensitive drums 31. This prevents wear of, for example, the transfer belt 20 and the surfaces of the individual photosensitive drums 31.

The present embodiment is disclosed only by way of an example, and the present invention is not limited thereto. Rather, various modifications and changes may of course be made in the invention, without departing from the spirit of the invention. For example, the embodiment is designed such that since the same driving manner is applied for the three colors other than black, phase matching is not required; the color copier wherein may be such that different driving is performed for the individual colors. In this case, the arrangement may preferably be such that, in the manner similar to that described above, the phases of individual color photosensitive drums 31 are extracted, and the phase correction operation is executed for all the colors. Another example is that, in the above-described embodiment, although the phase correction is executed only at the power-ON time, the correction may be executed by necessity in the non-imaging time, such as the time after printing of a predetermined number of sheets or the time of shift between monochrome printing and color printing. As another example, although the present invention is adapted to the color copier 1 in the above-described embodiment, the present invention may be adapted not only to color copiers of that type, but also to a variety of apparatuses such as color printers and facsimile machines.

According to the imaging apparatus of the present invention, a velocity fluctuation component of a transfer belt and a velocity fluctuation component of each individual photosensitive drum can be separately detected even without addition of components such as a sensor and writing means other than a conventionally provided mark sensor.

What is claimed is:

1. An imaging apparatus comprising:

a transfer belt;

a drive roller that drives the transfer belt;

an imaging section that has a cylindrical photosensitive body and that forms patterns on the transfer belt;

a phase changing section that changes a phase relationship between a rotation angle of the drive roller and a rotation angle of the photosensitive body;.

a registered-mark forming section that forms registered marks on the transfer belt by using the imaging section before and after the phase relationship is changed by the phase changing section;

a mark sensor that senses marks formed on the transfer belt; and a velocity-fluctuation-component acquisition section that acquires at least one of a velocity fluctuation component of the photosensitive body and a velocity fluctuation component of the transfer belt in accordance with a result of sensing by the mark sensor for the registered marks formed before and after the phase relationship is changed by the phase changing section.

2. An imaging apparatus according to claim 1, further comprising a belt-position shifting device that shifts the transfer belt between a state in press-contact with the photosensitive body and a state disengaged from the photosensitive body, wherein the phase changing section uses the belt-position shifting device to change the phase relationship in the state where the transfer belt is disengaged from the photosensitive body.

3. An imaging apparatus according to claim 1, wherein the phase changing section changes the phase relationship by changing a relative velocity between the transfer belt and the photosensitive body for a predetermined time.

4. An imaging apparatus according to claim 1, wherein the drive roller and the photosensitive bodies body have the same diameter.

5. An imaging apparatus according to claim 4, wherein the angle to be changed by the phase changing section in the phase relationship between the drive roller and the photosensitive body between two times of registered marks forming by the registered-mark forming section is an odd multiple of 180 degrees.

6. An imaging apparatus according to claim 1, wherein the angle to be changed by the phase changing section in the phase relationship between the drive roller and the photosensitive body between two times of registered marks forming by the registered-mark forming section is an odd multiple of 180 degrees.

7. An imaging apparatus according to claim 1, wherein the velocity-fluctuation-component acquisition section acquires the velocity fluctuation component of the photosensitive body in accordance with the result of sensing by the mark sensor for the registered marks formed before and after the phase relationship is changed by the phase changing section.

8. An imaging apparatus according to claim 7, further comprising:

a plurality of imaging sections; and a phase matching section that matches phases of individual photosensitive bodies with one another by using the phase changing section in accordance with velocity fluctuation components of two or more imaging sections.

9. An imaging apparatus according to claim 8, wherein the registered-mark forming section uses two or more imaging sections thereby to synchronously form registered marks on the transfer belt.

10. An imaging apparatus according to claim 8, wherein:

the plurality of imaging sections includes a black imaging section and a non-black imaging section; and the phase matching section matches the phases of a photosensitive body of the black imaging section and a photosensitive body of the non-black imaging section with each other.

11. An imaging method for an imaging apparatus comprising a transfer belt, a drive roller that drives the transfer belt, and an imaging section that has a cylindrical photosensitive body, the method comprising the steps of:

forming first registered marks on the transfer belt by using the imaging section;

changing a phase relationship between a rotation angle of the drive roller and that of the photosensitive body after the first registered marks has been formed;

forming second registered marks on the transfer belt by using the imaging section after the phase relationship has been changed;

sensing the first registered marks;

sensing the second registered marks; and acquiring at least one of a velocity fluctuation component of the photosensitive body and a velocity fluctuation component of the transfer belt in accordance with a result of the sensing of the first and second registered marks.

12. An imaging method according to claim 11, wherein the phase relationship between the drive roller and the photosensitive body is changed by changing a relative velocity between the transfer belt and the photosensitive body for a predetermined time in a state where the transfer belt is disengaged from the photosensitive body.

13. An imaging method according to claim 11, wherein the drive roller and the photosensitive body that are used have the same diameter.

14. An imaging method according to claim 11, wherein the angle to be changed in the step of changing the phase relationship between the drive roller and the photosensitive body is an odd multiple of 180 degrees.

15. An imaging method according to claim 11, wherein the velocity fluctuation component of the photosensitive body is acquired in accordance with a result of the sensing of the first and second registered marks.

16. An imaging method according to claim 11, wherein:

the imaging apparatus for which the method is used comprises a plurality of imaging sections; and the method further comprises the step of matching phases of individual photosensitive bodies with one another in accordance with velocity fluctuation components of two or more imaging sections.

17. An imaging method according to claim 16, wherein two or more imaging sections are used whereby to synchronously form registered marks on the transfer belt in the step of forming the first or second registered marks.

18. An imaging method according to claim 16, wherein two or more imaging sections are used whereby to synchronously form registered marks on the transfer belt in the steps of forming the first and second registered marks.

19. An imaging method according to claim 16, wherein:

the plurality of imaging sections to be used in the method includes a black imaging section and a non-black imaging section; and the step of matching phases of individual photosensitive bodies is executed for a photosensitive body of the black imaging section and a photosensitive body of the non-black imaging section with each other.

20. An imaging method according to claim 11, further comprising the steps of:

forming an image on the transfer belt by using the imaging section; and transferring an image on the transfer belt to a recording medium.

* * * * *